US005281073A

United States Patent [19]

Gesuale

[11] Patent Number: 5,281,073

[45] Date of Patent: Jan. 25, 1994

[54] APPARATUS FOR THE TRANSPORT AND MANAGEMENT OF LIQUID BEARING WASTE

[76] Inventor: Thomas Gesuale, 36 Landview Dr., Dix Hills, Huntington, N.Y. 11746

[21] Appl. No.: 769,100

[22] Filed: Sep. 30, 1991

[51] Int. Cl.[5] ..... B65D 21/04; B66F 9/12

[52] U.S. Cl. ..... 414/421; 414/724; 220/1.5; 206/515

[58] Field of Search ..... 220/1.5, 4.03, 4.12, 220/4.13, 628, 636; 206/515; 414/422, 607, 608, 421, 642, 664, 668, 672, 724, 785

[56] References Cited

U.S. PATENT DOCUMENTS

| | | | |
|---|---|---|---|
| 728,037 | 5/1903 | Stone | 220/4.12 |
| 2,685,398 | 8/1954 | King | 220/1.5 X |
| 3,093,254 | 6/1963 | Sammarco | 220/4.12 X |
| 3,286,861 | 11/1966 | Ehrhorn | 414/421 |
| 3,435,982 | 4/1969 | Sneed | 206/515 X |
| 4,354,600 | 10/1982 | Treiber | 206/515 X |
| 4,416,374 | 11/1983 | Smith et al. | 220/1.5 X |
| 4,572,374 | 2/1986 | Sirotkin | 206/515 X |
| 4,662,669 | 5/1987 | Erickson et al. | 220/1.5 X |
| 4,682,727 | 7/1987 | Stoll | 206/515 X |
| 4,913,301 | 4/1990 | Pickler | 206/515 X |
| 5,022,546 | 6/1991 | Bock | 220/4.03 |
| 5,127,524 | 7/1992 | Howitt | 206/509 |

FOREIGN PATENT DOCUMENTS

| | | | |
|---|---|---|---|
| 2363471 | 6/1975 | Fed. Rep. of Germany | 220/628 |
| 188397 | 7/1990 | Japan | 414/664 |
| 624636 | 8/1981 | U.S.S.R. | 220/1.5 |
| 1242437 | 7/1986 | U.S.S.R. | 414/421 |
| 1298184 | 3/1987 | U.S.S.R. | 414/422 |

OTHER PUBLICATIONS

Dempster Dumpster Catalog Brief 160, Feb. 1960.

*Primary Examiner*—David A. Bucci
*Assistant Examiner*—Stephen Gordon
*Attorney, Agent, or Firm*—Ike Aruti

[57] ABSTRACT

An apparatus is provided for the transport and management of liquid bearing waste, such as sludge and ash, having a container body which tapers inwardly from the top to the bottom so that the majority of the container is able to be nested vertically within an empty container of similar construction. The container has a pair of elongated support rails longitudinally affixed thereto, the support rails and each of the container sidewalls having a pair of apertures transversely therethrough to enable lifting and manipulation of the containers by apparatus such as a forklift. A modified forklift is also provided adapted to tilt its blades downwardly to a substantially vertical angle to enable tipping the containers for emptying.

8 Claims, 3 Drawing Sheets

APPARATUS FOR THE TRANSPORT AND MANAGEMENT OF LIQUID BEARING WASTE

FIELD OF THE INVENTION

The present invention relates to waste management systems, and more particularly to apparatus for the transport and management of liquid bearing waste such as sludge and ash.

BACKGROUND OF THE INVENTION

In recent times, environmental concerns have significantly changed the manner in which liquid bearing waste is disposed of. Where such waste was once simply discarded in any manner which was most convenient, it must now be collected and transported to a processing facility where it is decontaminated in accord with a variety of federal, state and local regulatory provisions, and then transported to a governmentally approved disposal site for final elimination.

These requirements make the once simple affair very handling intensive, insofar as the waste must be put into a container for accumulation and the container then manipulated for transport, and the container must be manipulated again upon delivery at the processing site. The container must further be manipulated to empty the contents for processing, including moving of the container to the appropriate location for emptying, and possibly tipping the container for emptying into the processing apparatus. The temporarily empty container must then be moved to another location and stored until it is to be moved to another location for refilling with the waste which has been processed and otherwise decontaminated in conformity with the appropriate regulations. The refilled container must be again manipulated for loading and again transported to the final dumping site, where it is typically unloaded to await further manipulation for final dumping. The emptied container is then stored until it can be returned to its owner, who will again store it until it is put back in service, repeating the above process of transporting, manipulating, storing, etc..

Transport of the liquid bearing waste is typically accomplished by either railway or truck so that sufficiently large quantities can be accommodated to make such handling economical. Accordingly, the containers used for such waste are typically box type railway cars, in the case of railway transport, and box type roll off containers, such as those used by the Dempster Dinosaur or the like, in the case of truck transport. These known types of transport containers offer the important advantage of being able to be left behind after transport, so that the transporting vehicle of may continue productively without awaiting filling, emptying, or processing.

Unfortunately, these known methods of transporting waste impose their own requirements in terms of expensive specialized facilities and equipment. For example, in order to enable railway transport of the waste, the handling facility must be located near railroad tracks and have some network of rails for movement of the containers, with the added need for equipment to move the railway cars. Additionally, sufficient vacant track space is needed for temporary storage of the railway cars. The high cost and geographic requirements of providing a facility so equipped to accommodate railway car containers is often preclusive, and necessitates truck transport as an alternative.

Currently used means for truck transport of the liquid bearing waste likewise has significant disadvantages. For example, trucks adapted for the loading, unloading and transport of roll off containers, such as the Dempster Dinosaur, are specialized and expensive, which is likely to necessitate the special dispatch of such a vehicle when transport of such a container is necessary. Because these trucks are adapted to handle a specialized container, very often the trip to pick up such a container, or the return trip after dropping off such a container are done without a paying load, which in turn adds to fuel usage and transportation costs, since the expenses of the empty trip must be absorbed nonetheless. Another disadvantage of such transport of these containers is that the empty containers require as much space as full containers, and in the case of truck transport, often only one such container can be transported at a time.

The containers themselves in which the liquid bearing waste is transported have significant disadvantages beyond their need for specialized transport vehicles. Because the containers are specialized, they are often custom fabricated, which precludes their manufacture by modification of preexisting containers which are no longer suitable for their original purpose. Furthermore, just as the presently known containers require the same amount of space for transport whether full or empty, they require the same amount of space for storage whether full or empty. This can require considerable real estate resources, which is costly and particularly inefficient in the case of empty containers.

Another problem with these known containers is that their structures are adapted primarily for complementing their respective transport vehicles, and not for manipulation or transport after being unloaded from their vehicles. Thus it is often quite difficult to move the containers from place to place as necessary for filling, emptying or storing, and specialized equipment such as cranes are necessary to do so. Likewise, because of their structure, the containers are not suited to being tipped over by substantially unmodified common equipment, which could otherwise be the most convenient and economical means of emptying.

While nestable waste containers are known such as that taught by Bock, U.S. Pat. No. 5,022,546, such containers are heavy to transport and quite expensive to manufacture, and they do not nest within one another to a sufficient degree when empty to make storage or transport of numerous units particularly efficient. Furthermore, their construction necessitates special and expensive equipment for manipulation and dumping or emptying.

Consequently, a need exists for an improved waste container for liquid bearing waste such as sludge and ash, and means for the manipulation and management thereof.

OBJECTS AND ADVANTAGES

Accordingly, it is an object of the present invention to provide a container for liquid bearing waste such as sludge and ash, which is of a construction which enables the majority thereof to nest within another container of similar construction when the container it is nested into is empty, so that a plurality of empty containers of such construction may be efficiently stored and transported in little more space than is required for a single container.

Another object of the present invention is to provide a container for liquid bearing waste which can be manipulated and transported by a forklift.

Yet another object of the present invention is to provide a container for liquid bearing waste that satisfies the aforementioned objects, and is constructed from a recycled oil storage tank.

Still another object of the present invention is to provide a container for liquid bearing waste which can be tipped downwardly for emptying by forklift type equipment having only minor modifications.

A further object of the present invention is to provide modified structure for adaptation of forklift type equipment to enable the downward tipping of liquid bearing waste containers for the emptying of such containers.

Other objects and features of the present invention will be obvious to those of skill in the art upon contemplation of the disclosure herein in connection with the accompanying drawings. It is to be understood, however, that the drawings are designed for the purpose of illustration only and not as a definition of the limits of the instant invention, for which reference should be made to the claims appended hereto.

SUMMARY OF THE INVENTION

The present invention overcomes the above noted drawbacks of prior liquid bearing waste containers and means for management of them, and provides a nestable container for holding such waste which is easily manipulated and transported with common equipment, and also provides a forklift adapted for the downward tipping of the containers for emptying. One container embodiment is constructed predominantly of easily obtainable used material, for lowered cost and resource conservation.

The container comprises an elongated open top body having sidewalls and end walls which taper inwardly in the downward direction from the top toward a container body bottom having a truncated cross section. This structural configuration enables a plurality of the containers to be nested into stacks when empty, with the major portion of an upper container fitting within the cavity of the container below. This enables the efficient storage and transport of the containers when empty.

The container further has at least one pair of apertures through each sidewall adapted to receive forklift blades and enable lifting, stacking, unstacking, transport and manipulation thereby. The container has a pair of elongated support rails affixed longitudinally thereto at the sides, and each support rail has a pair of spaced apertures transversely therethrough which are likewise adapted to enable manipulation by a forklift. The support rails additionally provide support means for the container when a plurality of such containers are nested together in stacks when empty. The containers are adapted for transport by common flatbed.

The instant invention also provides a forklift adapted for the downward tipping of the containers for emptying. The forklift has extension pieces between the upper hydraulic rams and the frontal forklift frame to enable downward tipping of the forklift blades to a substantially vertical angle. The frontal ends of the forklift blades have means for retaining a container thereon and preventing the container from falling off the blades when tipped for emptying. The adapted forklift also has ballast adjustably affixed to the rear end to serve as a counterweight for the prevention of forward tipping of the forklift due to excessively heavy and overhung loads.

BRIEF DESCRIPTION OF THE DRAWINGS

In the drawings, wherein the same reference numeral denotes the same element throughout the several views.

DETAILED DESCRIPTION OF THE PREFERRED EMBODIMENTS

Figure 1:
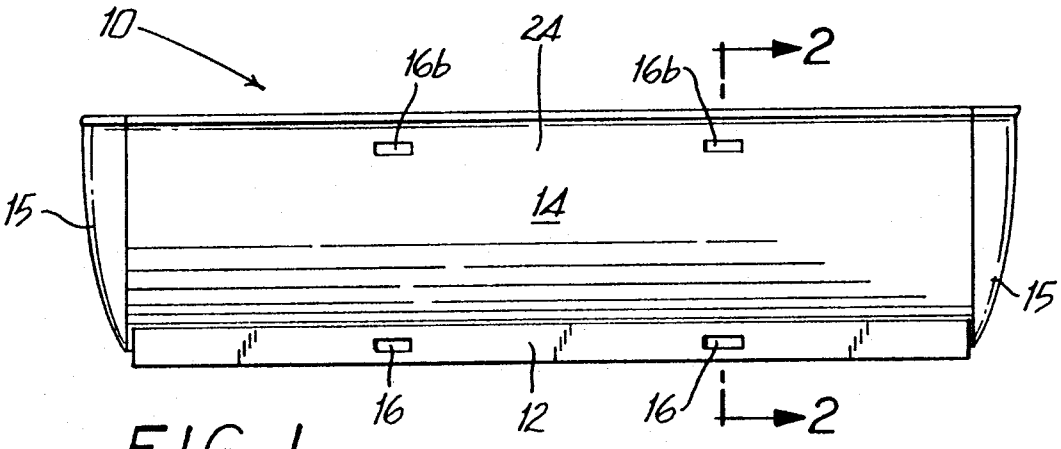
FIG. 1 is a diagrammatic representation of a semicylindrical embodiment of the nestable waste container of the instant invention.

Turning now to FIG. 1, a first embodiment of a container according to the present invention is shown, generally designated by the numeral 10. The container has a pair of elongated support rails 12 longitudinally affixed, preferably by welding, to the container body 14, and a convex end panel 15, affixed at each end of the container body. Each of the support rails has a pair of apertures 16 transversely therethrough adapted to receive and permit complete through passage of the blades 18 of a forklift 20, such as that shown in FIG. 6, or any other forklift of sufficient capacity and dimension.

Figure 2:
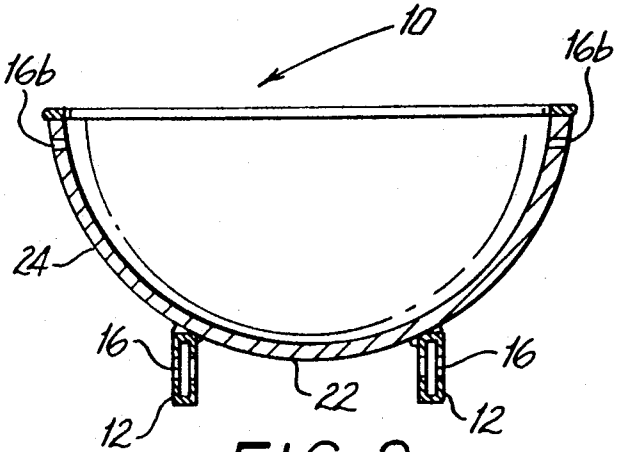
FIG. 2 is a sectional view of the container of FIG. 1, as taken along line 2—2.

In the container embodiment shown in FIG. 1, it can be seen from the sectional view of FIG. 2, that the elongated support rails are affixed to the bottom of container body 14, in substantially parallel position, and so that apertures 16 of each rail 12 are aligned with those of the other support rail. The rails are spaced sufficiently apart to provide both a stable base for container 14 to rest upon, and to provide stability of the container when lifted by a forklift when the blades 18 are inserted through apertures 16 of both support rails 12. It should be noted that because the container of FIG. 1 has a semicylindrical structure for container body 14, that the affixation position of support rails 12 must be sufficiently close together so that the bottom 22 of container body 14 is positioned above the apertures 16 to avoid interference of container bottom 12 with the insertion of forklift blades through the apertures of both support rails. Sidewall apertures **16*b*** are also provided near the top of the container for lifting, stacking, and unstacking.

Figure 7:
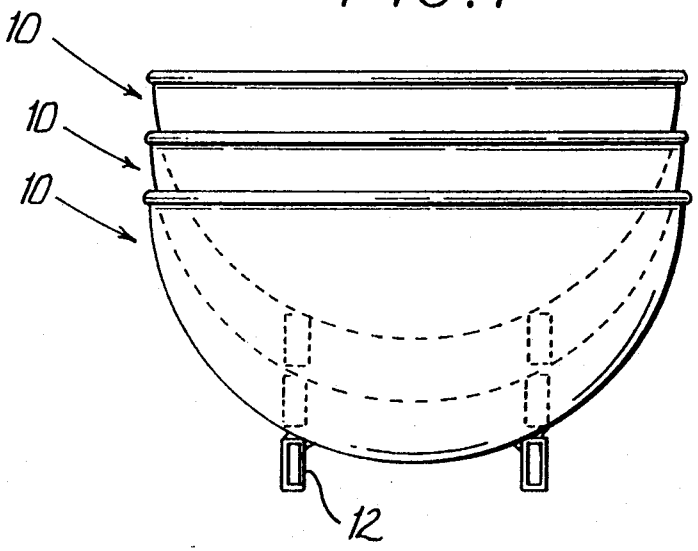
FIG. 7 is an illustration of several of the containers of FIG. 1 nested within one another.

The semicylindrical body 14, and convex end panels 15 taper inwardly in the downward direction. The significance of this is that the lower portions of the container 10 are smaller than respectively upper portions, and enables the efficient nesting of several of the containers substantially within one another when the containers are empty. FIG. 7 illustrates a nested stack of the containers of FIG. 1, the major portion of each upper container fitting within the open top cavity of the container beneath it. This enables the nesting of several containers in only slightly more space than is required for a single container, so that a plurality of such empty containers can be stored or transported more efficiently.

An important feature of containers having the above described semicylindrical structure is that they may be manufactured at low cost from used underground storage tanks, such as those used for heating oil, gasoline and the like. A common configuration for such storage tanks is a 10,000 gallon model, being approximately 20 feet long and 8 feet in diameter, which, when cut longitudinally in half, results in a pair of container bodies of a size well suited to the usage contemplated herein. This, combined with the fact that environmental regulations have required the disinterment of such underground storage tanks, they are presently in plentiful and inexpensive supply. Thus, the instant container of semicylindrical design can be fabricated from slightly recycled used materials rather than new materials, being beneficial because it reduces the environmental impacts associated with disposing of the used tanks or melting them down for reclamation of their steel. Obviously, the tanks should be tested for leakage before use as contemplated herein because sludge, ash and such wastes often contain liquids, particularly after processing, and it is undesirable to have these liquids leak from the container. Clearly, the leak testing is more easily done before cutting them in half.

Figure 3:
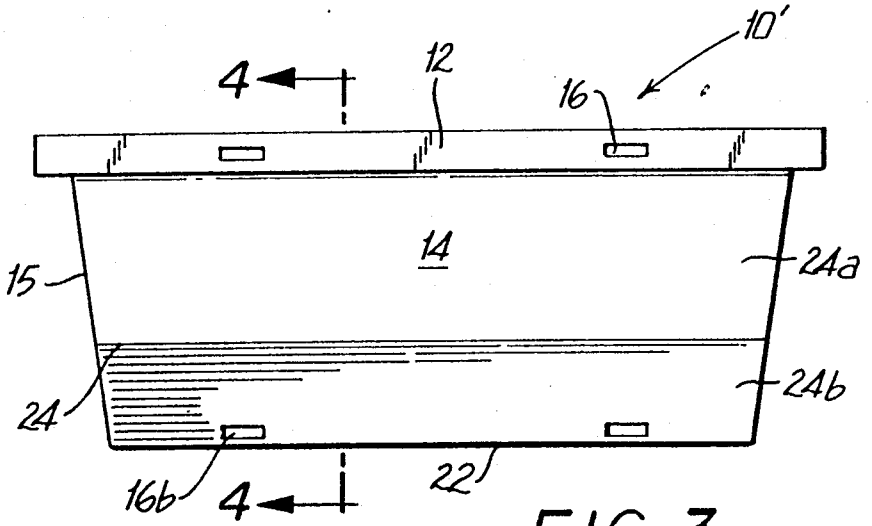
FIG. 3 is a diagrammatic representation of a second embodiment of the nestable waste container of the instant invention.

Turning now to FIG. 3, a second embodiment of the container 10' is shown. In this embodiment, the elongated support rails 12 are affixed to the top of container body 14, and again, support rail apertures 16 are arranged to enable forklift blades 18 to be inserted through the apertures of both rails, so that the container can be lifted from the top.

Figure 8:
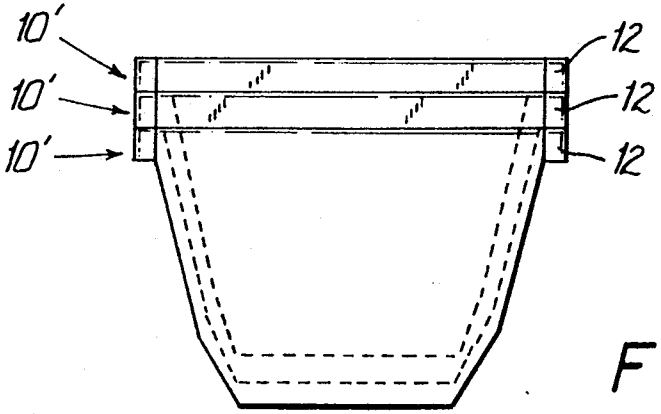
FIG. 8 is an illustration of several of the containers of FIG. 3 nested within one another.

Container sidewalls 24, bottom 22, and end panels 15, are made from flat pieces of sheet metal which taper inwardly in the downward direction so that lower portions of the container 10' are smaller than respectively upper portions of the container. This, as in the above described container embodiment, enables the nesting of a plurality of such containers within one another, with almost all of an upper container fitting within the open top cavity of the container beneath it. This can be seen from the illustration of FIG. 8, which shows a nested stack of containers 10' of FIG. 3.

Each sidewall 24 has a pair of spaced lifting apertures 16*b* therethrough near the container bottom 22. These apertures 16*b* of each sidewall 24 are positioned in transverse alignment with apertures 16*b* of the opposite sidewall 24, so that blades 18 of a forklift can be inserted through the apertures 16*b* of one sidewall 24, and protrude out from the apertures 16*b* of the opposite sidewall 24.

Figure 4:
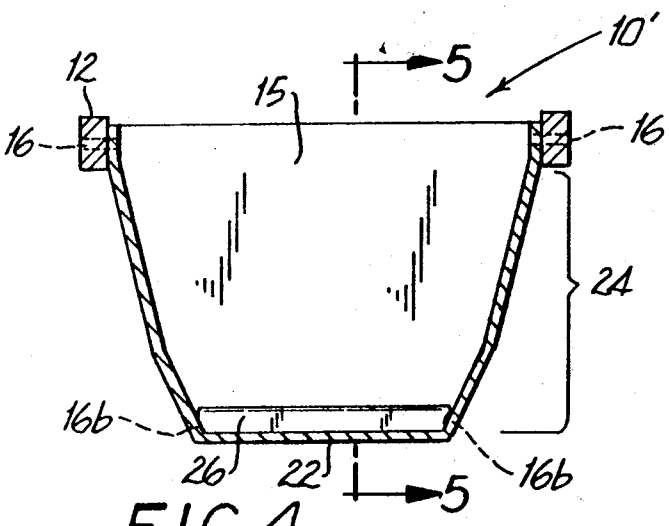
FIG. 4 is a sectional view of the container of FIG. 3, as taken along line 4—4.
Figure 5:
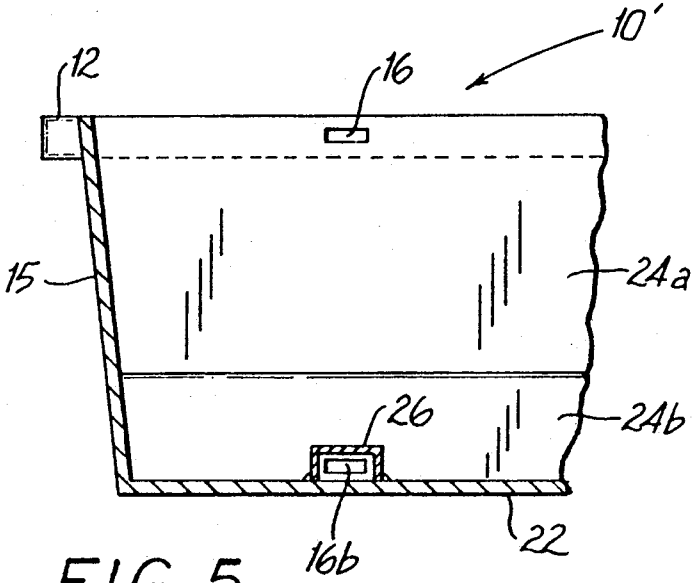
FIG. 5 is a sectional view of the container of FIG. 3, as taken along line 5—5 of FIG. 4.

Turning now to FIG. 4, a sectional view of container 10' of FIG. 3 is shown. As can be seen from FIG. 4, an elongated member 26 is positioned transversely across the inside of container 10', affixed to the container body bottom 22 and sidewalls 24. As shown in the FIG. 5 sectional view of container 10', elongated member 26 has an inverted "U" shape, and is affixed to the container bottom and sidewalls so that a sealed channel for receiving forklift blades 18 is formed communicating between the aligned apertures 16*b* of the opposing sidewalls 24. Each pair of opposing apertures 16*b* has an elongated member 26 therebetween. Thusly constructed, the contents of container 10' will not leak through apertures 16*b*.

The degree to which a container 10' will nest within another of like construction is governed by the height of elongated member 26. Where the height of elongated member 26 is fabricated to be less than that of support rail 12', multiple empty containers will nest almost completely within one another, provided sidewalls 24 and end panels 15 are sufficiently tapered, so that the support rails of the containers 10' abut vertically against one another.

An advantage of the construction of container 10' as shown in FIG. 3 is that it may be made of lighter gauge material than is typically used for the storage tanks used according to the embodiment shown in FIG. 1, which results in correspondingly lighter overall weight. Obviously, container 10' may also be made of lightweight material, such as aluminum, as compared to the typical steel construction of the storage tank used for the container of FIG. 1, to further reduce the weight of container 10'. This, combined with the greater degree of nestability of container 10' of FIG. 3, as compared to container 10 of FIG. 1, enables transport or storage of a greater number of empty containers, while remaining within the same permissible weight and height limitations as may exist. In the case of transport, the efficient nestable design of either embodiment results in substantial conservation of fuel when compared to the numerous trips that would necessary to transport non nesting containers.

While it is obvious that the containers of the above described embodiments may be made of any size or capacity, the preferred sizes would be approximately 20 feet long so that two stacks of empty containers, or two full containers can be accommodated upon a common 40 foot flatbed type trailer. Likewise, the preferred capacity of the containers would be that sufficient to comfortably hold 20 cubic yards, so that relatively common equipment can lift and manipulate the containers when full.

It is also a significant advantage that containers of the instant embodiments upon a flatbed truck or railway car. These flatbeds are comparatively inexpensive, and therefore common, and transport registries can be consulted, and the otherwise empty return trips of flatbed type vehicles can be made productive through transport of containers as described herein. This results in the conservation of resources including fuel, which in turn reduces adverse consequential impact upon the environment.

Figure 6:
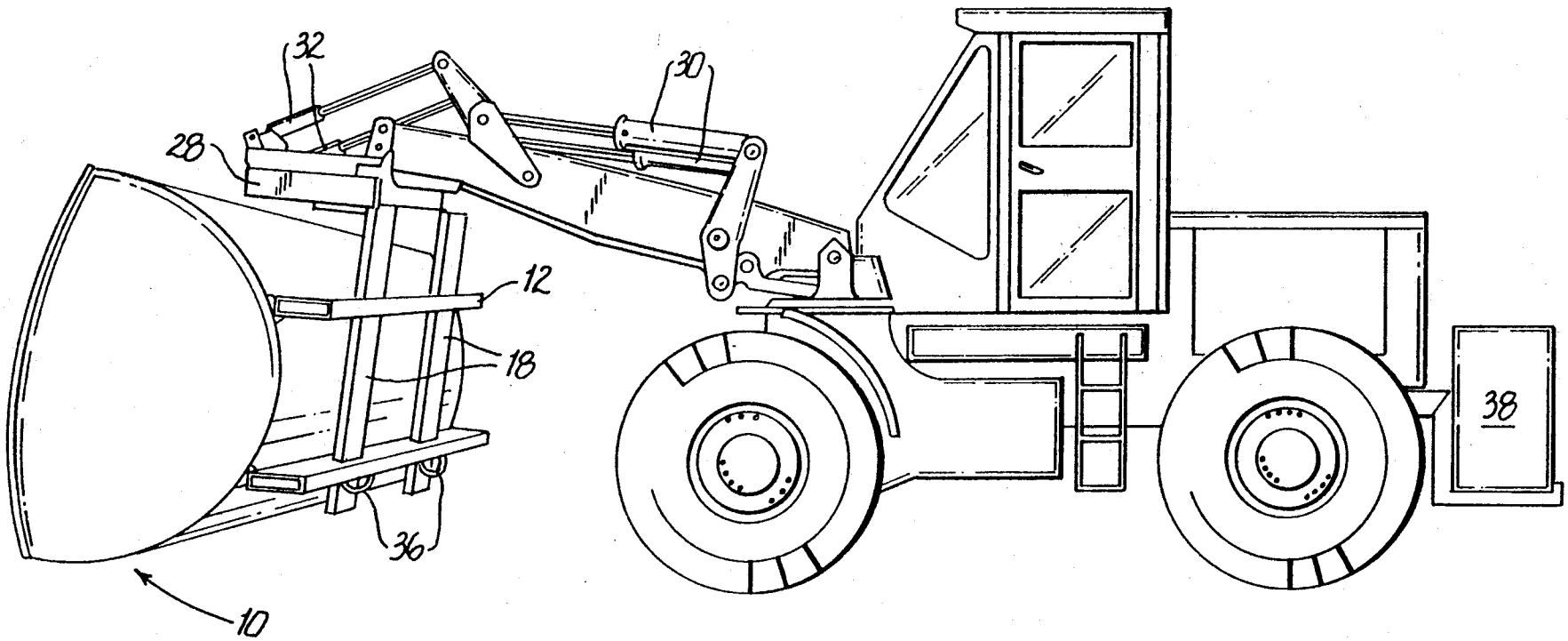
FIG. 6 is an illustration of a forklift adapted for tipping the containers of the present invention.

Turning now to FIG. 6, a heavy duty forklift 20 is shown as prepared from a modified Caterpillar model 988. The forklift has a frontal frame 28 from which a pair of blades 18 extend forwardly. The components between the body of the forklift and frame 28 are shown of exaggerated length for purposes of illustration.

Frame 28, and consequently, blades 18 are positionally controlled by upper and lower pairs of adjustable length hydraulic rams 30, lower rams not shown. The rams are in turn responsive to operator controls located in the cab of the forklift. While the aforementioned containers can be loaded onto flatbeds or removed therefrom, manipulated, transported, nested into stacks, or unstacked by any common forklift of sufficient capacity, the forklift of FIG. 6 has minor modifications to enable the additional function of tilting blades 18 downwardly to a substantially vertical angle. This enables the downward tipping of containers 10 carried by forklift 20 for emptying. These modifications include the effective lengthening of upper rams 30 by the addition of extension pieces 32 between the upper ram and the top of frame 28, and the formation of apertures, not shown, in the forward ends of blades 18. Thus when blades 18 are inserted through apertures 16 in the case of a container constructed according to the embodiment shown in FIG. 1, or through lower apertures 16*b* in the case of a container constructed according to the embodiment shown in FIG. 3, a retaining pin such as clevis pin 36 is installed in the blade aperture to prevent the container from sliding from blades 18 when tilted for emptying. Other means for preventing container slippage from the blades will be obvious to those of skill in the art, such as employing different pin styles or providing upturned lips etc. at the ends of blades 18, without departing from the spirit or scope of the instant invention.

It should be noted that the rounded bottom structure of the container of FIG. 1 is significant in that such a bottom structure will not interfere with the front wheels of the forklift 20 during tipping operations. If a sufficiently truncated lower cross section is not provided on the container, this can be remedied by the addition of extension pieces similar to those described above between the lower hydraulic rams 30 and the bottom of frame 28, combined with corresponding lengthening of extension pieces 32. This is not desirable because it would position the forklift load further forward, which in turn would increase the tendency for the forklift to tip forwardly upon lifting the load.

Forklift 20 has a counterweight ballast 38 to compensate for such an overhung load problem, however, if lower extension pieces of substantial length are necessary to provide front wheel clearance when tipping the container, ballast 38 will need to be increased, or preferably, positioned more rearwardly. Accordingly ballast 38 is mounted to the body of forklift 20 with means not shown, to enable fore and aft positioning of the ballast. Furthermore, in container 10′ as shown in FIGS. 3 and 4, sidewalls 24 are formed of upper segments 24*a* and lower segments 24*b*, wherein lower segments 24*b* taper inwardly in the downward direction to a significantly greater degree than upper segments 24*a* to provide additional front wheel clearance when container 10′ is tipped by forklift 20 for emptying.

While the above specification contains many specificities. these should not be construed as limitations on the scope of the instant invention, but rather as an exemplification of the preferred embodiments thereof. Accordingly, the scope of the instant invention should not be determined by the embodiments shown, but rather by the claims appended hereto and their legal equivalents.

What is claimed is:

1. A system for the transport and management of bulk material including: a container having an open top and a closed bottom; a pair of opposing sidewalls between said top and said bottom, said sidewalls being tapered inwardly downward from said top to said bottom, each of said sidewalls having a pair of spaced apertures therethrough, each aperture in each sidewall being in transverse alignment with an aperture in the opposing sidewall so that said container may be lifted or manipulated by a forklift after insertion of forklift blades through the apertures of both said sidewalls: a pair of opposing end panels, each said end panel being leak resistently affixed to said bottom and between said opposing sidewalls, said end panels being tapered inwardly downward from said top to said bottom so that a leak resistent container body is formed by said sidewalls, said end panels and said bottom; and a pair of elongated support rails, said support rails being affixed longitudinally to said container body, said support rails each having a pair of apertures transversely therethrough, the apertures of each said support rail being in transverse alignment with the apertures through the other support rail so that said container may be lifted or manipulated by a forklift after insertion of forklift blades through the apertures of both said support rails, said container being progressively smaller from said top to said bottom so that said container is able to be vertically nested within another container of similar construction.

2. The apparatus as set forth in claim 1, further comprising a pair of elongated members transversely oriented within said container, said elongated members having an inverted substantially U shaped cross section, and wherein said support rails are outboardly affixed to said container body upon said sidewalls near the top of said sidewalls, and the apertures in said sidewalls are near said bottom of said container, and each said elongated member is affixed to said bottom and to said opposing sidewalls around the sidewall apertures so that a sealed channel is formed by each said elongated member between each pair of transversely aligned sidewall apertures.

3. The apparatus as set forth in claim 1, wherein said sidewalls and said bottom are formed by a continuous piece of material having semicylindrical shape, and said end panels are outwardly convex in shape.

4. The apparatus as set forth in claim 3, wherein said support rails are affixed to said container body between said bottom and said sidewalls so that said bottom of said container body is positioned above the apertures in said support rails.

5. The apparatus as set forth is claim 3, wherein said container body is fabricated from one or more of the pieces which result when a cylindrical storage tank has been divided longitudinally into halves.

6. The system for the transport and management of bulk material as set forth in claim 1, further comprising a forklift, said forklift having a frontal frame and a pair of forwardly extending elongated blades mounted to said frame, said forklift having means for tilting the front of said blades downwardly to a substantially vertical orientation so that said container, when carried by said blades, can be emptied by tilting said blades downwardly.

7. The system according to claim 6, said forklift further comprising means located near the front of at least one of said blades for preventing the slippage of said container therefrom when said blades are tilted downwardly.

8. The system according to claim 6, said forklift further comprising a plurality of telescopingly extendable and retractable hydraulic rams coupled to said frame for the positional control of said frame and blades with respect to the body of said forklift, and wherein said means for tilting said frame and blades comprises an elongated extension member added between one or more of said hydraulic rams and the top of said frame.

* * * * *